United States Patent [19]

Chubb et al.

[11] 4,445,356

[45] May 1, 1984

[54] COMBINED PORTABLE SHEET BENDING BRAKE AND COIL HOLDER

[75] Inventors: Arthur B. Chubb, Wyandotte; Richard J. MacLeod, Milford; James J. Rhoades, Garden City, all of Mich.

[73] Assignee: Tapco Products Company, Inc., Detroit, Mich.

[21] Appl. No.: 352,893

[22] Filed: Feb. 26, 1982

[51] Int. Cl.[3] ..... B21D 5/04

[52] U.S. Cl. ..... 72/319; 242/78.7

[58] Field of Search ..... 72/318–323, 72/316, 419; 242/78.7, 68.7; 83/649, 453

[56] References Cited

U.S. PATENT DOCUMENTS

| | | | |
|---|---|---|---|
| 3,310,451 | 3/1967 | Hartley et al. | 83/649 |
| 3,310,452 | 3/1967 | Hartley et al. | 83/649 |
| 3,817,075 | 6/1974 | Marsh et al. | 72/319 |
| 3,957,220 | 5/1976 | Beck et al. | 242/68.7 |
| 4,246,817 | 1/1981 | Marsh et al. | 83/455 |
| 4,291,845 | 9/1981 | Van Cleave | 242/78.7 |
| 4,364,254 | 12/1982 | Chubb et al. | 72/319 |

FOREIGN PATENT DOCUMENTS

| | | | |
|---|---|---|---|
| 2507422 | 8/1975 | Fed. Rep. of Germany | 83/649 |
| 797273 | 4/1936 | France | 242/78.7 |

*Primary Examiner*—Daniel C. Crane

*Attorney, Agent, or Firm*—Barnes, Kisselle, Raisch, Choate, Whittemore & Hulbert

[57] ABSTRACT

A combined portable sheet bending brake and coil holder wherein the coil holder is mounted and removed from the brake without the use of tools. The brake comprises a frame having a fixed jaw and a movable jaw, an anvil member secured to the fixed jaw, the movable jaw having a clamping surface movable between workpiece clamping and non-clamping positions relative to the anvil member. A bending member is hinged to the fixed jaw. The coil holder supports a coil of sheet material. The frame of the brake and the coil holder have interengaging hooks whereby the coil holder may be mounted and removed from the frame. When the coil holder is in position, the coil is positioned such that the leading edge of the coil may be extended between the clamping surfaces and clamped to permit cut off of a desired length of sheet material.

19 Claims, 4 Drawing Figures

COMBINED PORTABLE SHEET BENDING BRAKE AND COIL HOLDER

This invention relates to the handling of sheet material and particularly to a combined portable sheet bending brake and coil holder.

BACKGROUND AND SUMMARY OF THE INVENTION

It has become common to provide a portable sheet bending brake which is carried to the job site for bending metal or plastic sheet material such as used in siding on homes and buildings.

Typically, the portable sheet bending brakes are such as shown in U.S. Pat. Nos. 3,161,223, 3,481,174, 3,482,427, 3,559,444, 3,817,075 and 3,872,755 and comprise a frame having a fixed jaw and a movable jaw and an anvil member secured to the fixed jaw. The movable jaw has a clamping surface movable between workpiece clamping and non-clamping positions relative to the clamping surface on the fixed jaw. A bending member is hinged to the fixed jaw for bending the sheet material clamped between the two clamping surfaces.

More recently, coil holders have been provided which are utilized separately to uncoil a length of sheet material from a coil, clamp it, and thereby permit a predetermined length to be cut off. Such a coil holder is shown, for example, in U.S. Pat. No. 4,246,817. Such coil holders necessarily require a separate clamping construction for the sheet material.

The present invention is directed to a combined portable sheet bending brake and coil holder wherein the same structure that is utilized for clamping the sheet material for bending is also utilized for clamping the sheet material for cut off from a coil.

Among the objectives of the present invention are to provide a combined portable sheet bending brake and coil holder wherein the coil holder utilizes the same clamping structure as utilized in the sheet bending brake; wherein the coil holder may be readily applied and removed to the portable sheet bending brake; wherein the coil holder is light in weight, is constructed and arranged so that no tools or clamps are required to hold the coil in position, and includes a novel construction for supporting the coil.

In accordance with the invention, the frame of the brake and the coil holder have interengaging means whereby said coil holder may be mounted and removed from the frame. When the coil holder is in position, the coil is positioned such that the leading edge of the coil may be extended between the clamping surfaces and clamped to permit cut off of a desired length of sheet material. In a preferred construction, the coil support includes a novel construction for holding the coil on the coil support.

DESCRIPTION

Figure 1:
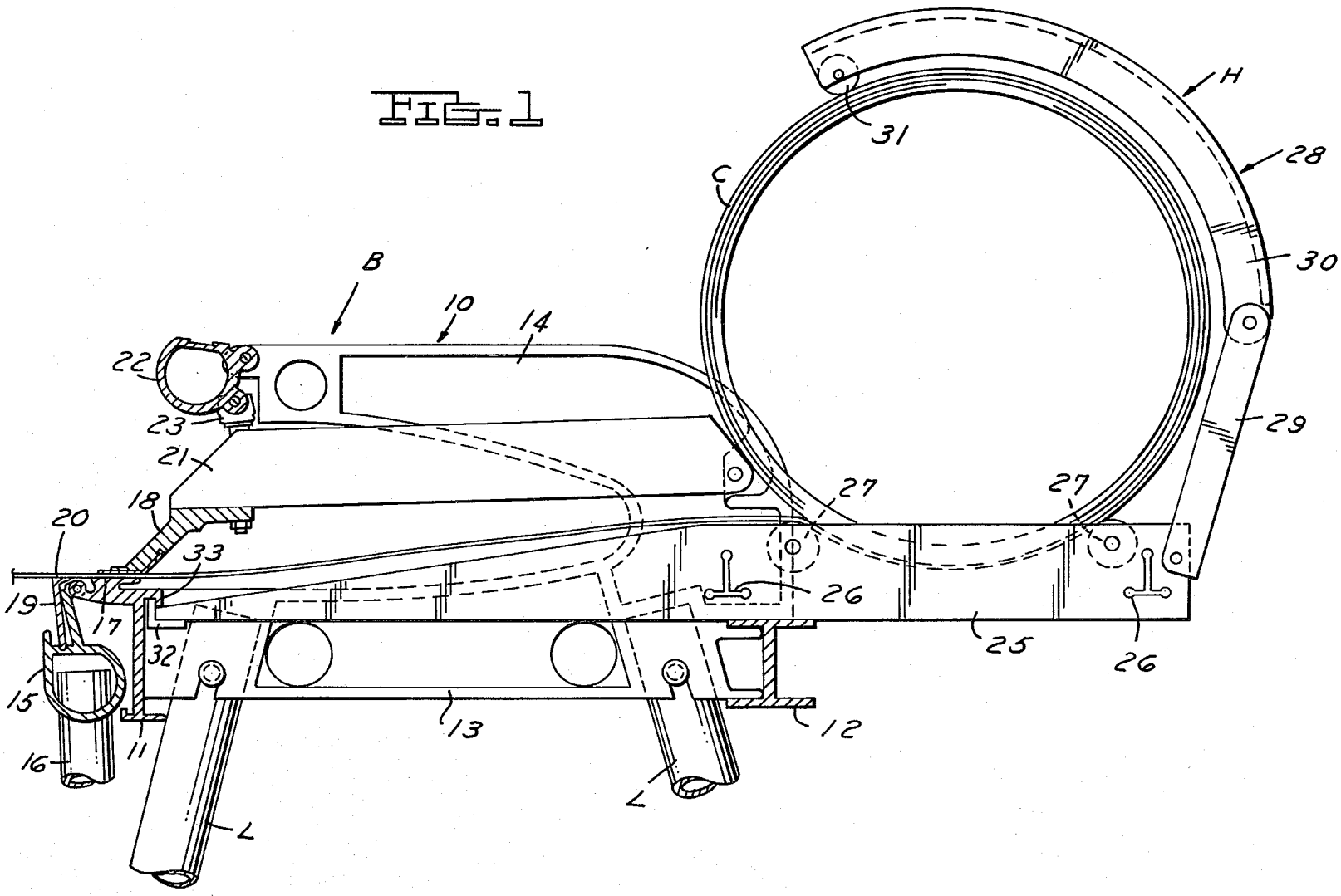
FIG. 1 is a part sectional side view of a combined portable sheet bending brake and coil holder embodying the invention.

Referring to FIG. 1, the invention comprises a portable sheet bending brake B and a coil holder H which is engageable and disengageable with the brake B, that is, the coil holder H may be readily applied to the brake B or removed from the brake B without the use of tools.

The brake comprises longitudinally spaced C-shaped frame members 10 connected by a front rail 11 and a rear rail 12. Each frame member 10 includes a lower arm 13 on which rail 11 is bolted as by bolts and rear rail 12 is bolted as by bolts. Each C-frame member 10 also includes an upper arm 14 which overlies the lower arm 13 in spaced relation thereto. Tubular legs L extend into integral sockets in some of frames 10 to support the brake above the floor. A bending member 15 in the form of an aluminum extrusion is hinged about a hinge axis to front rail 11 and one or more bending bar handle members 16 are fixed to the bending bar 15 for facilitating movement thereof. The upper portion 17 of front rail 11 is formed with a flat clamping surface defining an integral anvil member.

The rail 11 and bending member 15 are formed with mating integral projections along their longitudinal edges, which projections are provided with openings co-axially aligned with the projections intermeshed and a pin extends through the openings to complete the hinge between bending member 15 and rail 11. Other types of hinges can be used.

An movable jaw 18 is provided in overlying relation to the upper planar surface of portion 17.

A floating hinge compensator 19 is pivoted to bending member 15 by engagement with a groove in bending member 15. Springs (not shown) are interposed between member 15 and compensator 19. Hinge compensator 19 is provided along its opposite or outermost longitudinal edge with a foot portion 20 which is adapted to engage the sheet material.

As shown in FIG. 1, when the bending member 15 is out of bending position, the foot portion 20 of the hinge compensator 19 overlies the hinge connection and is disposed in a horizontal plane below that of the anvil member 18.

As the bending member 15 is swung upwardly from the position shown in FIG. 1 the compensator 19 pivots with foot portion 25 thereof riding upwardly relative to the lower planar surface of the workpiece, which is clamped relative to the anvil 21 by a clamping subassembly presently described.

When the workpiece has been bent to the desired angular shape, the movable jaw 18 is swung downwardly whereupon the foot portion 25 of the compensator 22 rides downwardly to return to its normal position wherein it overlies the hinge connection. The compensator 22 thus serves to tend to minimize marring of the sheet and provide a continuous bending pressure to product the desired bend.

The clamping sub-assembly includes a channel-shaped pivot bar 21 on each frame 10 on which bending member 18 is fixed. Bar 21 is pivoted at its opposite innermost end to upper arm 14 of each C-frame 10.

A handle member 22 is pivoted along one of its edges to the forward end of upper arm 14 of each C-frame 10 and is pivotally connected to pivot bar 21 by a plurality of links 23 pivoted at its upper end to an edge of the handle member and at its lower end to the pivot bar 26.

A tension spring (not shown) is connected at one end to upper arm 14 and at its opposite end to pivot bar 21 to yieldingly urge each bar 21 upwardly. This construction is substantially shown in U.S. Pat. Nos. 3,481,174 and 3,482,427 which are incorporated herein by reference.

The coil holder H comprises a coil support frame including spaced side rails 25 and cross rails 26. Rollers 27 are rotatably mounted between the side rails 25 for supporting the coil C of sheet material such as aluminum or plastic and hold downs 28 each in the form of a straight lever 29 pivoted to the rear of rails 21 and a curved lever 30 pivoted to lever supporting a roller 31 maintains the coil in position against the first-mentioned rollers. The front ends of the side rails are provided with an upwardly extending hook 32 that engages below a complementary hook 33 on the rear of the front rail 11. When in position, the rear portion of the coil holder H is supported on the upper surface of the rear rail 12 maintaining the hook in engagement. More specifically, the side rails 25 rest on rear rail 12.

Figure 2:
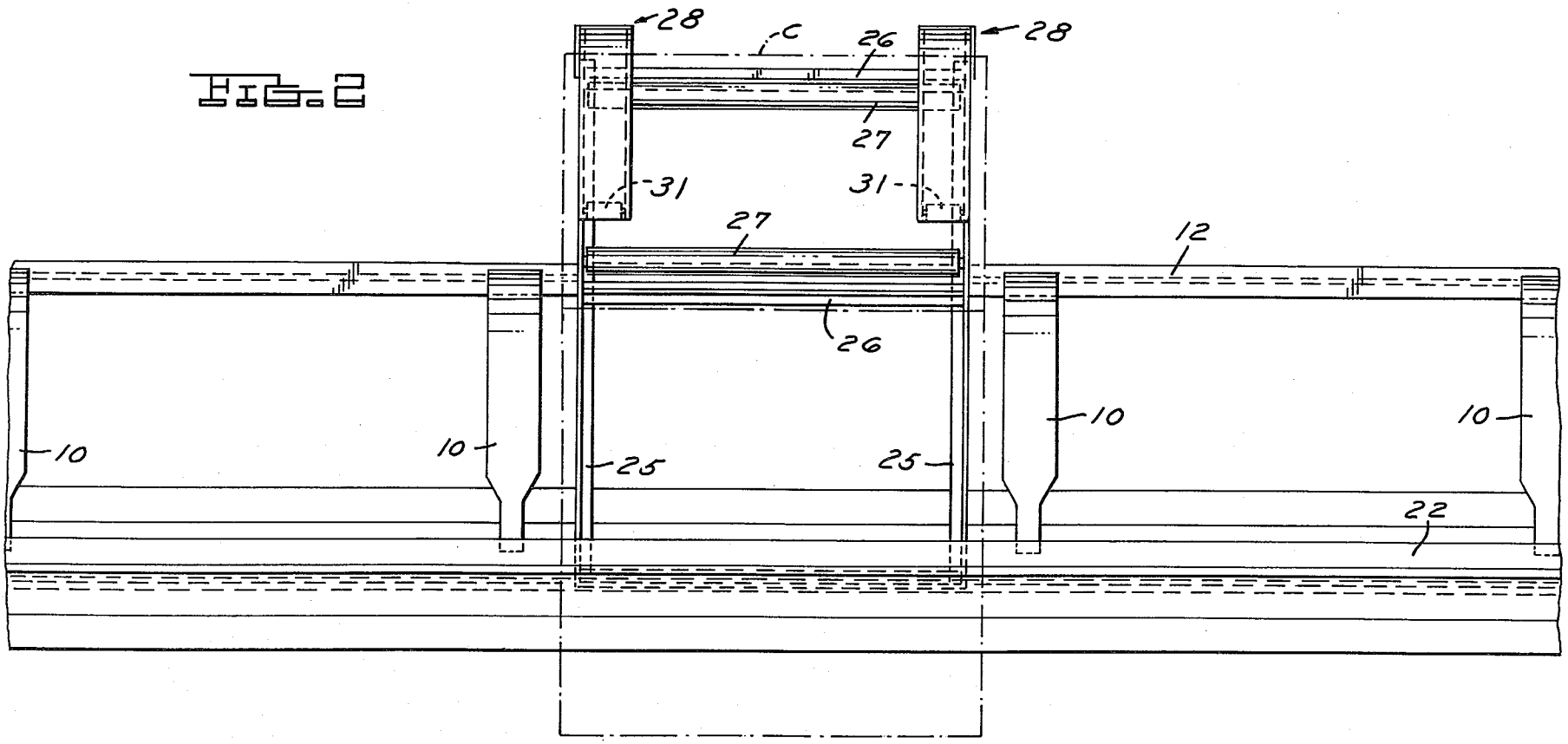
FIG. 2 is a fragmentary plan view thereof, parts being removed.

The coil holder 14 may be readily engaged or disengaged by moving the coil holder between a pair of C-shaped members 10 (FIG. 2) bringing the hook into engagement (FIG. 1). To remove the coil holder H, it is merely moved so that the hook 32 is disengaged from hook 33 and then the coil holder 14 is lifted from the sheet bending brake B.

When the coil holder H is in position, the desired length of sheet material is uncoiled from the coil C, threaded between the clamping surfaces and the clamping surfaces are brought into engagement to clamp the sheet so that the front edge of the anvil defines a surface or guide along which a knife can be moved to score and cut off the coil.

Figure 3:
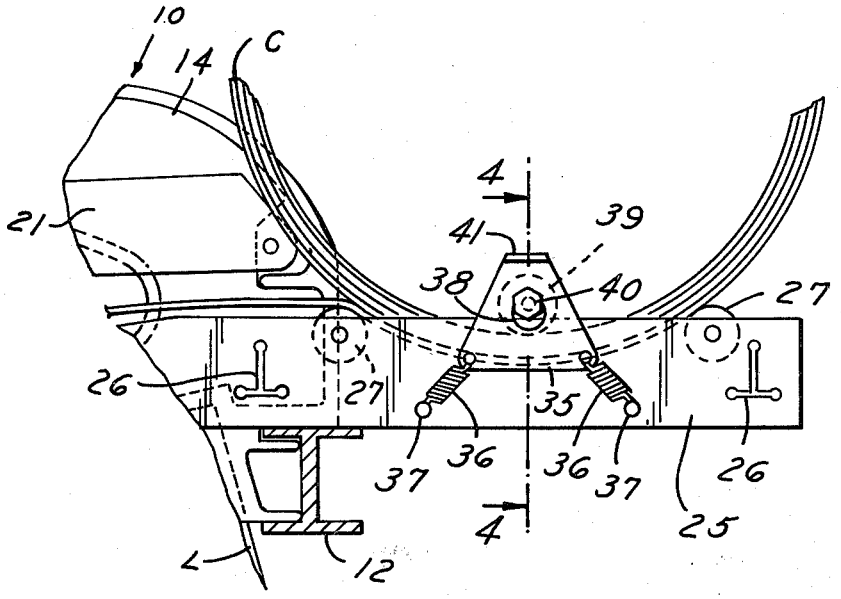
FIG. 3 is a fragmentary view of a modified form of coil support.
Figure 4:
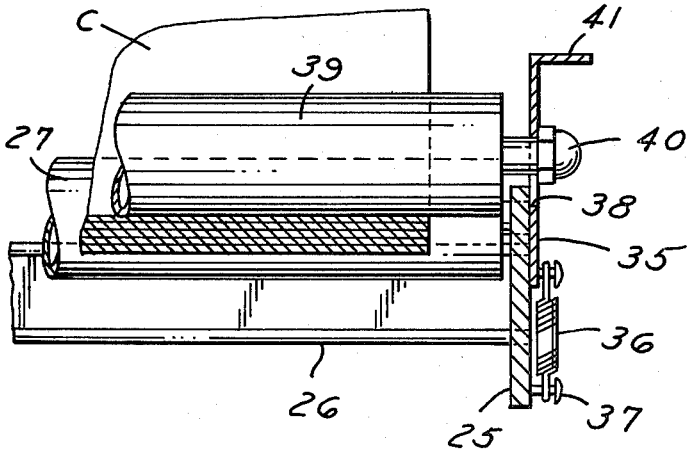
FIG. 4 is a fragmentary sectional view taken along the line 4—4 in FIG. 3.

FIGS. 3 and 4 show a coil support wherein the coil C is held in position on rollers 27 by a roller 39 that extends within the coil.

A headed screw 40 is threaded into the shaft of roller 39. The roller 39 is yieldingly urged against the interior of the coil by a bracket 38 at each end. Each bracket 38 is made of metal and is generally triangular in shape. Each bracket 38 includes an opening which is larger than the head of screw 40 so that the bracket can be telescoped over the nut 40.

Coil tension springs 36 have their lower ends attached to pins 37 on side rail 25 and their upper ends attached to the corners of bracket 38 so that after the bracket 38 is telescoped over the screw 40, it is yieldingly urged downwardly against the shaft of the roller 39 to hold the roller 39 against the interior of coil C and, in turn, hold the coil C against rollers 27. The coil support structure shown in FIGS. 3 and 4 can be used as a part of coil supports other than the hook-on type shown in FIGS. 1 and 2.

We claim:

1. A combined portable sheet bending brake and coil support comprising a frame having a fixed jaw and a movable jaw, an anvil member secured to the fixed jaw and having a clamping surface, said movable jaw having a clamping surface movable between workpiece clamping and non-clamping positions relative to the anvil member, means for locking the movable jaw and workpiece in clamping position, a bending member hinged about a hinge axis to the fixed jaw, a coil holder having means for supporting a coil of sheet material, said coil holder being mounted on said frame so as to position the axis of the coil of sheet material substantially parallel to the hinge axis of the bending member, said frame and said coil holder having interengaging means whereby said coil holder may be mounted and removed from said frame such that when the coil holder is in position, the coil is positioned such that the leading edge of the coil may be extended between the clamping surfaces of said anvil and movable jaw and clamped to permit cut off of a desired length of sheet material.

2. The combined portable sheet bending brake and coil holder set forth in claim 1 wherein said last-mentioned means comprises a hook portion on said coil holder and a complementary portion on said sheet bending brake.

3. The combined portable sheet bending brake and coil holder set forth in claim 2 wherein said hook portion on said coil holder extends upwardly from said coil holder, said frame of the sheet bending brake having a complementary portion extending downwardly relative to the frame.

4. The combined portable sheet bending brake and coil holder set forth in claim 3 wherein said coil holder includes a front part adjacent said anvil and a rear part, said hook portion being on a front part of the coil holder and engaging the front of the sheet bending brake adjacent the anvil, said rear part of said coil holder overlying a part of the frame such that the frame supports the rear portion of the coil holder.

5. The combined portable sheet bending brake and coil holder set forth in claim 1 wherein said coil holder comprises side frame members, rollers extending between said side frame members for supporting a coil of sheet material, hook portions on the side frame members and complementary portions on the sheet bending brake engaged by said hook portions.

6. The combined portable sheet bending brake and coil holder set forth in claim 5 wherein said coil holder is positioned such that the weight of the coil holder maintains engagement of the hook portion to the brake.

7. The combined portable sheet bending brake and coil holder set forth in claim 5 wherein said frame comprises spaced front and rear rails, said front rail supporting said anvil, said hook portion engaging the front rail and the rear portion of the coil holder overlying the upper portion of the rear rail.

8. A combined portable sheet bending brake and coil support comprising a frame having a fixed jaw and a movable jaw, said frame comprising a pair of spaced front and rear rails, a plurality of C-shaped members positioned on said rails at longitudinally spaced points, each said C-shaped member comprising a lower arm fixed to the rails and an upper arm spaced from and overlying the lower arm, an anvil member having a clamping surface being fixed on the lower arms, said movable jaw having a clamping surface movable between workpiece clamping and non-clamping positions relative to the anvil member, means for locking the movable jaw and workpiece in clamping position, a bending member hinged about a hinge axis to the fixed jaw, a coil holder having means for supporting a coil of sheet material, said coil holder being mounted on said frame so as to position the axis of the coil of sheet material substantially parallel to the hinge axis of the bending member, said frame and said coil holder having interengaging means whereby said coil holder may be mounted and removed from said frame between a pair of said C-shaped members such that when the coil holder is in position, the coil is positioned such that the leading edge of the coil may be extended between the clamping surfaces of said anvil and movable jaw and clamped to permit cut off of a desired length of sheet material.

9. The combined portable sheet bending brake and coil holder set forth in claim 8 wherein said last-mentioned means comprises a hook portion on said coil holder and a complementary portion on said sheet bending brake.

10. The combined portable sheet bending brake and coil holder set forth in claim 9 wherein said hook portion on said coil holder extends upwardly from said coil holder, said frame having a complementary portion extending downwardly relative to said frame.

11. The combined portable sheet bending brake and coil holder set forth in claim 10 wherein said coil holder includes a front part adjacent said anvil and a rear part, said hook portion being on a front part of the coil holder and engaging said front rail of said frame, said rear part of said coil holder overlying the rear rail of the frame such that the frame supports the rear portion of the coil holder.

12. The combined portable sheet bending brake and coil holder set forth in claim 8 wherein said coil holder comprises side frame members, rollers extending between said side frame members for supporting a coil of sheet material, said hook portions being on the side frame members and said complementary portions on the sheet bending brake engaged by said hook portions being on said front rails of said frame.

13. The combined portable sheet bending brake and coil holder set forth in claim 12 wherein said coil holder is positioned such that the weight of the coil holder maintains engagement of the hook portion with the brake.

14. The combined sheet metal brake and coil support set forth in claim 8 wherein said front part of the coil holder includes a front part adjacent said anvil and a rear part, said front part extending under said front rail and said rear part overlying said rear rail.

15. A combined portable sheet bending brake and coil support comprising a frame having a fixed jaw and a movable jaw, an anvil member secured to the fixed jaw and having a clamping surface, said movable jaw having a clamping surface movable between workpiece clamping and non-clamping positions relative to the anvil member, means for locking the movable jaw and workpiece in clamping position, a bending member hinged about a hinge axis to the fixed jaw, a coil holding having means for supporting a coil of sheet material, said coil holder being mounted on said frame so as to position the axis of the coil of sheet material substantially parallel to the hinge axis of the bending member, said frame and said coil holder having interengaging means whereby said coil holder may be mounted and removed from said frame such that when the coil holder is in position, the coil is positioned such that the leading edge of the coil may be extended between the clamping surfaces of said anvil and movable jaw and clamped to permit cut off of a desired length of sheet material, said means for supporting said coil comprising a coil support frame including spaced rollers for engaging the periphery of the coil, a third roller extending through the interior of said coil, and means yieldingly urging the third roller toward the first mentioned rollers comprising a bracket connected to the coil support frame solely by spring means, said bracket having means engaging at least one end of said third roller and being manually disengageable from said third roller.

16. The combined portable sheet bending brake and coil support set forth in claim 15 wherein said means engaging said third roller comprises an enlarged portion on said third roller, said bracket having an enlarged opening telescoped over said enlarged portion.

17. The combined portable sheet bending brake set forth in claim 15 or 16 wherein said spring means comprises spaced tension springs, each having one end connected to said bracket and the other end to said coil support.

18. The combined portable sheet bending brake set forth in claim 15, 16 or 17 wherein said bracket includes a tab for manually engaging said bracket to engage and disengage said shaft.

19. The combined portable sheet bending brake and coil support set forth in claim 15, 16, 17 or 18 wherein a substantially identical bracket is provided at each end of said third roller.

* * * * *